US011645908B2

(12) United States Patent
Eilertsen

(10) Patent No.: US 11,645,908 B2
(45) Date of Patent: May 9, 2023

(54) ROAD TUNNEL SECURITY SYSTEM

(71) Applicant: Roger Andre Eilertsen, Askim (NO)

(72) Inventor: Roger Andre Eilertsen, Askim (NO)

( * ) Notice: Subject to any disclaimer, the term of this patent is extended or adjusted under 35 U.S.C. 154(b) by 12 days.

(21) Appl. No.: 17/254,065

(22) PCT Filed: Jun. 14, 2019

(86) PCT No.: PCT/NO2019/000019
§ 371 (c)(1),
(2) Date: Dec. 18, 2020

(87) PCT Pub. No.: WO2019/245377
PCT Pub. Date: Dec. 26, 2019

(65) Prior Publication Data

US 2021/0264780 A1 Aug. 26, 2021

(30) Foreign Application Priority Data

Jun. 18, 2018 (NO) ..... 20180845
Jul. 2, 2018 (NO) ..... 20180931

(51) Int. Cl.
*G08G 1/0969* (2006.01)
*G08G 1/065* (2006.01)
*G08G 1/01* (2006.01)

(52) U.S. Cl.
CPC ..... *G08G 1/065* (2013.01); *G08G 1/0112* (2013.01); *G08G 1/0145* (2013.01); *G08G 1/0969* (2013.01)

(58) Field of Classification Search
CPC ..... G08G 1/065; G08G 1/012; G08G 1/0137; G08G 1/0175; G08G 1/0969; G08G 1/017; G08G 1/0112; G08G 1/0145
See application file for complete search history.

(56) References Cited

U.S. PATENT DOCUMENTS

2013/0018578 A1* 1/2013 Matsuo ..... G09B 29/007 701/431
2019/0389465 A1* 12/2019 Ogino ..... B60W 30/18009
2021/0264780 A1* 8/2021 Eilertsen ..... G08G 1/0969

FOREIGN PATENT DOCUMENTS

EP 2 541 196 A1 1/2013
JP 2011039038 A * 2/2011 ..... G01C 21/00
(Continued)

OTHER PUBLICATIONS

International Search Report, International Application No. PCT/NO2019/000019, dated Sep. 10, 2019.

*Primary Examiner* — Andrew W Bee
(74) *Attorney, Agent, or Firm* — Morse, Barnes-Brown & Pendleton, P.C.; Sean D. Detweiler, Esq.

(57) ABSTRACT

A road tunnel security system includes a road security server system in communication with respective tunnel security client systems arranged and associated with respective cars. A specific tunnel security client system is configured to download a computer coded road map from the road security server system, including at least one tunnel. A first virtual gate is located in front of a first tunnel opening, and a second virtual gate is located In front of a second tunnel opening. When a car enters the tunnel, the first virtual gate submits the license number plate to the road security system, and when the car leaves the tunnel the registered license number plate is deleted on request from the second virtual gate. In this manner the road security server keep track of all cars and their license plate numbers that are inside the tunnel at any time.

14 Claims, 1 Drawing Sheet

(56) References Cited

FOREIGN PATENT DOCUMENTS

| | | | | | |
|---|---|---|---|---|---|
| KR | 20080076247 | A | * | 8/2008 | ..... G01C 21/30 |
| KR | 20140083690 | A | * | 12/2012 | ..... G01C 21/36 |
| TW | 200813401 | A | * | 3/2008 | ..... G01C 21/165 |
| WO | WO 2017/022263 | A1 | | 2/2017 | |

* cited by examiner

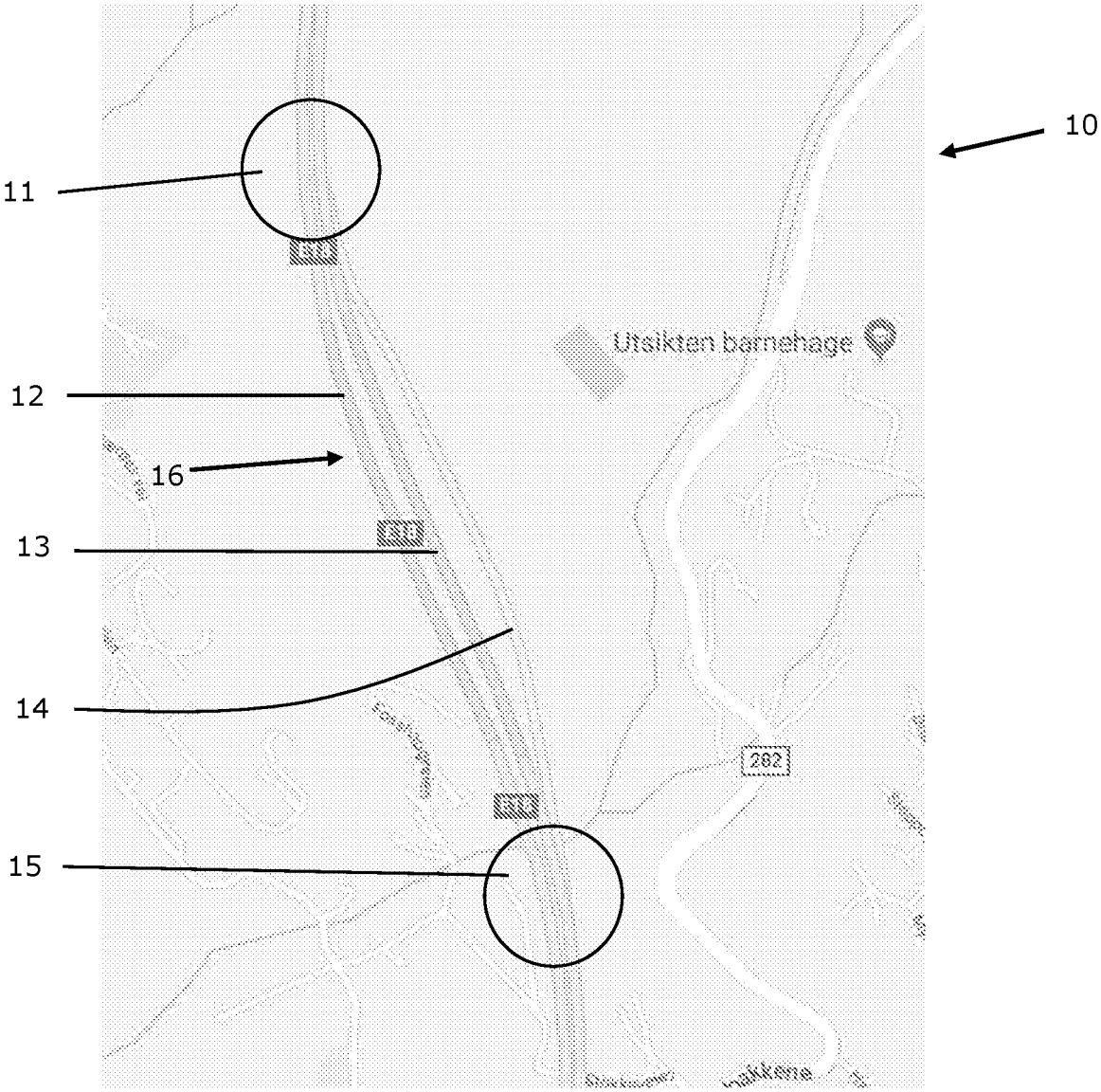
10
11
12
16
13
14
15
Utsikten barnehage
262

ROAD TUNNEL SECURITY SYSTEM

RELATED APPLICATIONS

This application is a national stage filing under 35 U.S.C. 371 of International Application No. PCT/NO2019/000019, filed Jun. 14, 2019, which claims priority to Norway Application No. 20180845, filed Jun. 18, 2018 and Norway Application No. 20180931, filed Jul. 2, 2018. The entire teachings of said applications are incorporated by reference herein.

FIELD OF THE INVENTION

The present invention is related to a road tunnel security system, and especially to a road tunnel security system recording positions and identity of all cars being present inside a tunnel at any time.

BACKGROUND OF THE INVENTION

Modern cars are changing their appearance from petrol driven speed monsters to electric and environmentally friendly computer driven machines. Many modern cars need software updates from time to time provided over the Internet instead of changing oil from time to time at workshops. In a sense, many modern cars are computers equipped with wheels and an electric motor.

Despite the "modernity" of new cars, accidents may appear with these cars as with the old ones.

One of the new trends is the use of for example computer coded Google maps installed in a computer system (or device) in cars. Updates sent from GPS (Global Positioning System) transceivers located in respective cars to a server system maintaining for example Google maps can be viewed in an Internet browser in computer devices or systems in respective cars. Based on the received data, Google map (i.e. the server system) can provide visual indications in maps of respective traffic levels on roads helping drivers to select better routs outside areas with traffic congestion for example.

The Internet as a communication infrastructure provides a possibility to communicate with cars from traffic control centers having an overview of the traffic situation in a city for example. Guidance and advice related to traffic problems provided to road users online can mitigate for example developments of ques in respective areas of a city. In addition, traffic control centers may have to its disposition software running advanced mathematical models of traffic as such, which can improve respective guidance and advice given by the traffic control center. It is important to get reliable forecasts of traffic developments before congestions happens. In the future, it is probable that such traffic control centers can operate without human intervention and in combination with for example self-driven cars, elimination or at least mitigation of the problem with traffic congestion is probable.

However, foreseeing accidents cannot be done via analysis. Accidents are by its nature random incidents. After occurrence of an incident, reporting the incident for example to the police is possible. The police can report the geographical position (GPS coordinates) of the accident and maybe the severity of the accident. The reporting is normally to other emergency units like the fire brigade and/or health teams etc. In addition, the report can be submitted to a server system updating for example Google maps. Then a graphical symbol located at the corresponding GPS position of the accident will be visible in every car viewing the google map online.

If the accident happens inside road tunnels, the situation is different. When for example a police car comes to the scene of the accident, access to the accident location inside the tunnel will normally be blocked by a queue of cars behind the location of the accident. The emergency teams arriving to the tunnel would like to know the location inside the tunnel the accident happened, how many cars are involved, are there children involved, type of injuries, risk of fire etc. All these types of assessments are difficult to do from the outside of a blocked tunnel.

Tunnels may have a communication infrastructure in place, for example a mobile phone network, broadband networks etc. However, if there is a fire there is a risk that the network infrastructure inside the tunnel is destroyed very quickly.

Another aspect of tunnels is that the body of for example the mountain the tunnel is passing is blocking any wireless communication between GPS transceivers and GPS satellites.

Therefore, the known possibility to identify locations of cars by tracking GPS positions is difficult in tunnels when there is a fire. Further, communicating with cars is also normally limited.

It is therefore a need of an improved road tunnel security system.

Object of the Invention

It is a further object of the present invention to provide an alternative to the prior art.

In particular, it may be seen as an object of the present invention to provide a road tunnel security system keeping records of the number of cars, the order of cars and their license plate numbers that are inside a tunnel at any time by configuring cars to monitor their own positions inside tunnels in an autonomous system.

SUMMARY OF THE INVENTION

Thus, the above described object and several other objects are intended to be obtained in a first aspect of the invention by providing a road tunnel security system comprising a road security server system in communication with respective tunnel security client systems arranged in and associated with respective cars, wherein a specific tunnel security client system is configured to download a computer coded road map from the road security server system, wherein the downloaded computer coded road map comprises at least one tunnel in the geographical area the requesting tunnel security client system is located, a first tunnel opening is marked with a first symbol in the map outside a first tunnel opening of the at least one tunnel, a second tunnel opening is marked with a second symbol in the map outside a second tunnel opening of the at least one tunnel, the first and second tunnel opening symbols in the downloaded map comprises embedded information comprising at least the respective GPS positions corresponding to GPS positions of the first tunnel opening and the second tunnel opening, respective tunnel security client systems are each configured to track positions of their associated car inside the tunnel by estimating a distance from the GPS positions of the first and second tunnel opening by sampling the velocity of the car over a series of consecutive defined time windows, respective tunnel security client systems are configured to identify when the associated car is entering the first tunnel opening, and when the associated car is outgoing from the second tunnel opening, respective tunnel security client systems are configured to signal the road security server system about the incident of the associated car entering the first tunnel opening and is transmitting at least a pre-stored license plate number of the associated car to the road security server system, and respective tunnel security client systems are further configured to signal the road security server system about the incident of the associated car outgoing from the second tunnel opening and is requesting the road security server system to delete the recorded license plate number recorded when entering the first tunnel opening.

Respective aspects of the present invention may each be combined with any of the other aspects. These and other aspects of the invention will be apparent from and elucidated with reference to the embodiments described hereinafter.

DESCRIPTION OF THE FIGURES

FIG. 1 disclose an example of embodiment of the present invention.

The road tunnel security system according to the present invention will now be described in more detail with reference to the accompanying FIGURES. The accompanying FIGURES illustrates an example of embodiment of the present invention and is not to be construed as being limiting to other possible embodiments falling within the scope of the attached claim set.

DETAILED DESCRIPTION OF AN EMBODIMENT

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. The mentioning of references such as "a" or "an" etc. should not be construed as excluding a plurality. The use of reference signs in the claims with respect to elements indicated in the FIGURES shall also not be construed as limiting the scope of the invention.

An aspect of the present invention is to improve tunnel security by recording cars entering and leaving a tunnel. One of the problems to be solved is the lack of GPS measurements inside a tunnel as discussed in the background of the description.

If it was a physical gate located outside a tunnel opening it is possible to stop cars, receiving information of respective license number plates etc. Such a physical gate would be located on a specific geographical position that can be identified with corresponding GPS coordinates.

Therefore, according to an aspect of the present invention, a virtual gate may be located at respective tunnel openings in a computer coded map, at GPS positions corresponding to the GPS positions physical gates would have been located.

A road security server system maintains maps, or map information layers, indicating GPS positions of for example virtual gates located in front of tunnel openings. Such computer coded maps can be downloaded to respective tunnel security clients associated with respective cars. A display system is connected to the tunnel security client system enabling visualizing respective virtual gates in front of tunnel openings with graphical symbols representing corresponding physical gates. The respective symbols are located at the GPS positions wherein corresponding physical gates would have been located if they were used. The road security client may be embedded into an existing navigation tool of the associated car.

The actual GPS coordinates of virtual gates and physical tunnel openings etc. can be embedded in respective graphical symbols in a map as known to a person skilled in the art.

FIG. 1 illustrate an example of a computer coded map 10 covering a specific limited geographical area comprising a tunnel 16. The tunnel security client system may from time to time, or on a regular basis, request the road security server of a computer coded map 10 to be installed and used in the associated car of the tunnel security client system. The requested computer coded map 10 will be a map of the geographical area around the geographical position the car is located on when the request for a map is issued.

Grant of a map download can be according to specific rules. For example, the tunnel security client system can be configured to support a standard car navigation system, and the need of a map download can be due to a situation wherein the car is driving outside the perimeter of the map residing at present in the navigation system of the car.

However, with respect to the object of the present invention, downloading of a computer coded map may be limited to situations wherein the geographical area of the map actually comprises at least one tunnel. If there is no tunnel, the downloading may be omitted.

It is also within the scope of the present invention to let a driver access a user interface connected to the tunnel security client system associated with his car enabling the driver to request the downloading of a map anyhow and at any time.

In FIG. 1, the tunnel 16 comprises a first traffic lane 12 supporting a first driving direction, and a second traffic lane 13 supporting a second driving direction opposite the driving direction of the first traffic lane 12.

There is also indicated a road 14 that passes outside the tunnel 16. This road may be used to get traffic passed the tunnel if the tunnel 16 I closed.

The tunnel 16 has a first tunnel opening associated with a first virtual gate 11 visualized as a circle. The first tunnel opening is for example a tunnel entrance guarded by the first virtual gate 11. The first tunnel opening is also for example an exit of the second traffic lane 13.

In the other end of the tunnel, there is a second virtual gate 15 also visualized as a circle in front of the second tunnel opening. The second tunnel opening is for example an exit for the first traffic lane 12, and an entrance for the second traffic lane 13.

According to an aspect of the present invention a road tunnel security system comprises a road security server system in communication with respective tunnel security client systems arranged and associated with respective cars.

A specific tunnel security client system is configured to download a computer coded road map from the road security server system, for example on a regular basis, or when needed, or on request from a driver as discussed above.

The downloaded computer coded road map 10 may comprise at least one tunnel in the geographical area the requesting tunnel security client system is located. The selection of the specific map can be done by the road security server system by reading out a GPS position from the tunnel security client system, and then identify a map section in a map library in the road security server system covering the GPS position of the client.

A first virtual gate 11 is marked with a first symbol in the map 10 outside a first tunnel opening of the at least one tunnel 16.

A second virtual gate 15 is marked with a second symbol in the map 10 outside a second tunnel opening of the at least one tunnel 10. The first and second virtual gate symbols comprises embedded information comprising at least the respective GPS positions corresponding to GPS positions of a first physical gate and a second physical gate the respective physical gates would have been located if they were physically installed.

A tunnel security client system according to the present invention is configured to track respective GPS positions of respective associated cars, and may further be configured to compare the tracked GPS position of the associated car with respective GPS positions of the first and second virtual gate being embedded in the respective symbols in the map 10. The comparison may also be done to the GPS positions of the actual tunnel openings.

The tunnel security client system is configured to identify when the associated car is approaching for example the first virtual gate 11, i.e. in front of for example the first tunnel opening of the tunnel 16, and when the associated car is leaving the second virtual gate 15, or is leaving for example the second tunnel opening of the tunnel 16.

According to a further aspect of the present invention, respective tunnel security client systems are configured to signal the road security server system about the incident of an associated car passing the first virtual gate 11 and is transmitting at least a pre-stored license plate number of the associated car to the road security server system.

When a car is leaving the tunnel 16, respective tunnel security client systems are further configured to signal the road security server system about the incident of the associated car passing the second virtual gate 15 and is requesting the road security server system to delete the recorded license plate number recorded when passing the first virtual gate.

The road security server system is configured to read out a set of tracked GPS positions of cars passing respective virtual gates 11, 15, (or respective tunnel openings) thereby being able to determine if a car is approaching an associated tunnel opening or is leaving an associated tunnel opening.

The first and second graphical symbol of the first and second virtual gate may comprise embedded information about the distance from a specific GPS position of the first and respective the second virtual gate to the first and the respective second tunnel opening. The tunnel security client system is configured to read out the distance to the associated tunnel openings when the associated car is approaching the first virtual gate, i.e. when entering a tunnel.

The tunnel security client system is further configured to start sampling the speed of the associated car at defined time intervals when passing for example the first virtual gate (or first tunnel opening). By sampling with a shorter time interval, calculating the distance travelled by the car will be more accurate since accelerations an braking will be averaged out in the calculation with shorter time intervals. Then the client system can keep track of how far inside the tunnel the associated car is located from the first tunnel opening or first virtual gate, and/or how close to the second tunnel opening or the second virtual gate the car is located.

The ability to identify when a car is entering a tunnel, and when a car is leaving the tunnel provides a possibility to measure the frequency of cars entering the tunnel and compare this value with the frequency of cars leaving the tunnel. The ideal situation is that both values are equal. However, if the frequency of cars entering the tunnel is higher that the frequency of cars leaving the tunnel it is a possibility of a traffic congestion in the tunnel. If this happens, the road security server system is configured to inform the first arriving cars identifying passing the first virtual gate about the situation, either informing them of stopping their car, or at least slowing down the speed. The frequency of cars can be measured by counting cars within a defined time period.

If the frequency of leaving cars is increasing, the stopped or slowed down cars can be instructed by the road security server to speed up when passing the exit of the tunnel for example when passing the second virtual gate.

The tunnel security client system may further be configured to detect if the associated car has stopped inside the tunnel, and is then recording the calculated distance from the entrance of the tunnel and the distance to the exit of the tunnel.

This information can be conveyed to a driver of the car by the tunnel security client system displaying a graphical indication on the connected display indicating which distance to the entrance or exit of the tunnel that is the shortest distance. The entrance and the exit is defined relative to the driving direction of the car. Then the driver knows which shortest way to go to get out of the tunnel in an emergency situation.

In such a system the tunnel security client system may also start recording a video of the surrounding area of the car. This video may be submitted to emergency personnel arriving to the tunnel if there has been an accident.

Another aspect of the present invention is that the road security server system keeps an ordered table of car identities of the cars that are detected to be inside the tunnel at any time, and the table is ordered with respect to traffic lane directions. A top entry of the table is then associated with the car that is closest to the exit of the tunnel, and the bottom entry of the table is the car closest to the entrance of the tunnel. The exit and entrance is defined relative to the driving direction of the associated traffic lane. In this manner emergency personnel can identify at least relative positions of respective cars inside the tunnel, the number of cars, license number of the cars and hence the identity of owners of the cars. This enables emergency personnel to find telephone numbers for example, which can be used if the communication infrastructure of the tunnel is not destroyed, for example due to a fire.

If the general communication infrastructure is destroyed or is broken inside the tunnel, the tunnel security client system may comprise a WIFI port enabling communication with corresponding equipped devices carried by emergency personnel. In this respect, drones equipped with WIFI can be sent inside the tunnel searching for live WIFI connections of respective cars enabling collecting information from inside the tunnel.

If the tunnel is full of smoke, an autonomous drone equipped with radars is capable of navigating inside the tunnel on its own.

According to an example of embodiment of the present invention, a road tunnel security system comprises a road security server system in communication with respective tunnel security client systems arranged in and associated with respective cars, wherein a specific tunnel security client system is configured to download a computer coded road map from the road security server system, wherein the downloaded computer coded road map comprises at least one tunnel in the geographical area the requesting tunnel security client system is located, a first tunnel opening is marked with a first symbol in the map outside a first tunnel opening of the at least one tunnel, a second tunnel opening is marked with a second symbol in the map outside a second tunnel opening of the at least one tunnel, the first and second tunnel opening symbols in the downloaded map comprises embedded information comprising at least the respective GPS positions corresponding to GPS positions of the first tunnel opening and the second tunnel opening, respective tunnel security client systems are each configured to track positions of their associated car inside the tunnel by estimating a distance from the GPS positions of the first and second tunnel opening by sampling the velocity of the car over a series of consecutive defined time windows, respective tunnel security client systems are configured to identify when the associated car is entering the first tunnel opening, and when the associated car is outgoing from the second tunnel opening, respective tunnel security client systems are configured to signal the road security server system about the incident of the associated car entering the first tunnel opening and is transmitting at least a pre-stored license plate number of the associated car to the road security server system, and respective tunnel security client systems are further configured to signal the road security server system about the incident of the associated car outgoing from the second tunnel opening and is requesting the road security server system to delete the recorded license plate number recorded when entering the first tunnel opening.

Further, the road security server system may be configured to read out GPS positions from tracked cars passing a first virtual gate located in a distance from the front of the first tunnel opening in the downloaded map, and to read out GPS positions of tracked cars passing a second virtual gate located in front of the second tunnel opening in the downloaded map.

Further, the first and second virtual gate may preferably be located adjacent to a respective side road in front of the respective first and second tunnel openings.

Further, the road security server system may be configured to and configured to determine if a specific car is approaching an associated tunnel opening or is leaving an associated tunnel opening by tracking the GPS position of the specific car relative to the GPS position of the respective first and second virtual gates.

Further, the first and second symbol of the first and second virtual gate may further comprises embedded information about the distance from the GPS positions of the first second virtual gate to the first and second tunnel opening, the tunnel security client system is configured to read out the distance of the associated tunnel opening when the associated car is passing the first virtual gate, and is further configured to start sampling the speed of the associated car at defined time intervals when passing the first virtual gate, thereby keeping track of how far inside the tunnel the car is located from the first tunnel opening, and/or how close to the second tunnel opening the car is located.

Further, the first virtual gate may be located adjacent to a side road outside the first tunnel opening.

Further, the second virtual gate may be located adjacent to a side road outside the second tunnel opening.

Further, a car may be entering the second tunnel opening and is outgoing from the first tunnel opening.

Further, the road security server system may configured to monitor a number of cars entering within a defined time period, and monitoring the number of cars outgoing from the tunnel within the same defined time period, and whenever the number of cars within the defined time period is higher than the number of cars leaving within the same defined time period.

the road security server system is configured to submit a warning of possible congestion of cars inside the tunnel when cars are detected to be entering the tunnel.

Further, whenever the number of leaving cars is approaching zero while the number of entering cars are increasing more than the number of outgoing cars, the road security server system instructs an approaching car to stop or slow down before entering the tunnel when detecting this condition.

Further, if the number of outgoing cars increases over a defined time period, the road security server system instructs a stopped car to start driving through the tunnel.

Further, the tunnel security system may be configured to advice the approaching car to use a side road located adjacent to a virtual gate the car is approaching.

Further, the tunnel security client system may be configured to detect if the associated car has stopped moving inside a tunnel, and is recording a calculated distance from the first and second tunnel opening.

Further, the security client system may display a graphical indication on a connected display indicating which distance to the first or second tunnel opening is the shortest distance.

Further, the tunnel security client system may be configured to start recording videos inside tunnel spaces and traffic situations with at least one connected video camera of the car.

Further, the road security server system may keep an ordered table of car identities of the cars that are inside the tunnel at any time, wherein the ordering follows geographical positions of cars on a traffic lane from the tunnel opening being the entrance opening of the traffic lane inside the tunnel.

Further, information of a car position and identity of cars inside the tunnel can be read out from the associated tunnel security client systems of respective cars via a wireless network connection arranged inside the tunnel.

Further, an emergency network may be established by a WIFI connection provided by at least one drone carrying a WIFI network connection, wherein the at least one drone is configured to search for live WIFI connections of cars inside the tunnel.

Further, the downloaded computer coded map may be an information layer superimposed in top of an already installed computer coded map in the tunnel security client system.

Further, the already installed map may be part of a car navigation system.

Further, a local area may be installed in the tunnel, and wherein locations of respective cars is identified by triangulation of WIFI signals between respective cars and nodes of the local area network inside the tunnel.

The invention claimed is:

1. Road tunnel security client systems, comprising:

a road security server system in communication with respective tunnel security client systems arranged in respective cars, wherein respective tunnel security client systems are configured to request a download of a computer coded road map from the road security server system;

a geographical area covered by the downloaded computer coded road map is based on a current Global Positioning System (GPS) position of a GPS transceiver of the requesting tunnel security client system, wherein the downloaded computer coded road map comprises at least one tunnel in the geographical area where the requesting tunnel security client system is located;

a first tunnel opening is marked with a first symbol in the downloaded computer coded road map outside the first tunnel opening of the at least one tunnel;

a second tunnel opening is marked with a second symbol in the downloaded computer coded road map outside the second tunnel opening located opposite the first tunnel opening of the at least one tunnel;

the first and second tunnel opening symbols in the downloaded computer coded road map comprises embedded information comprising at least respective GPS positions corresponding to GPS positions of the first tunnel opening and respectively the second tunnel opening;

wherein when a car arranged with the tunnel security client systems is approaching the at least one tunnel from outside of the at least one tunnel and is approaching the first or second tunnel opening, the tunnel security client system of the car is configured to track its own GPS positions relative to the GPS position of the first tunnel opening or the second tunnel opening dependent on which tunnel opening the car is approaching;

wherein when the tunnel security client system of the car detects that the associated car moving from the outside of the at least one tunnel is passing the GPS position of the first tunnel opening or the second tunnel opening, the tunnel security client system of the car is configured to transmit a message comprising a license plate number of the car to the traffic security server system indicating that the car is entering the tunnel via the first tunnel opening or the second tunnel opening;

wherein when the tunnel security client system of the car entering the at least one tunnel via the first or second tunnel opening is inside the at least one tunnel, the tunnel security client system is configured to estimate a distance from the GPS positions of the first or second tunnel opening the car entered the tunnel by sampling the velocity of the car over a series of consecutive defined time windows, thereby estimating a traveled distance inside the at least one tunnel at any time the car is inside the at least one tunnel relative to the first tunnel opening or the second tunnel opening;

wherein the tunnel security client system of the car is configured to use the estimated traveled distance to compare a distance remaining to the GPS position of the first tunnel opening or the second tunnel opening the car is moving toward when inside the tunnel;

wherein when the estimated distance remaining is close to zero the car is passing the respective GPS positions of the first or second tunnel opening the car is passing when moving out of the tunnel, the tunnel security client system of the car is configured to send a message to the traffic security server comprising the license plate number indicating that the car is moving out of the at least one tunnel.

2. The system of claim 1, wherein the road security server system is configured to monitor a number of cars entering the at least one tunnel within a defined time period, and monitoring the number of cars leaving the at least one tunnel within the same defined time period, and whenever the number of cars within the defined time period is higher than the number of cars leaving within the same defined time period, the road security server system is configured to submit a warning of possible congestion of cars inside the at least one tunnel when cars are detected to be entering the tunnel.

3. The system of claim 2, whenever the number of leaving cars is approaching zero while the number of entering cars are increasing more than the number of outgoing cars, the road security server system instructs an approaching car to stop or slow down before entering the at least one tunnel when detecting this condition.

4. The system of claim 3, whenever the number of outgoing cars increases over a defined time period, the road security server system instructs a stopped car to start driving through the at least one tunnel.

5. The system of claim 1, wherein the tunnel security client system is configured to detect when the associated car has stopped moving inside a tunnel based on a situation wherein the estimated distance remaining no longer changes, and is recording the calculated distance from the first and second tunnel opening.

6. The system of claim 5, wherein the tunnel security client system displays a graphical indication on a connected display inside the car indicating which distance to the first or second tunnel opening is the shortest distance.

7. The system according to claim 5, wherein the tunnel security client system is configured to start recording an inside space of the at least one tunnel recording traffic situations with at least one connected video camera of the car.

8. The system of claim 1, wherein the road security server system keeps an ordered table of car identities of the cars that are sending messages to the security server system when entering the at least one tunnel via the first or second tunnel opening, wherein the ordering follows geographical positions of cars on a traffic lane from the tunnel opening through which the cars are entering the at least one tunnel.

9. The system of claim 1, wherein information of a-car positions and identity of cars inside the tunnel can be read out from the associated tunnel security client system of respective cars via a wireless network connection arranged inside the tunnel.

10. The system of claim 9, wherein the network is a WIFI connection accessible by drones carrying WIFI network connections, wherein the drone can assemble information from a specific car comprising location of the car inside the tunnel and/or video recorded by the associated tunnel security client system.

11. The system according to claim 1, wherein the downloaded computer coded map is an information layer superimposed in top of an already installed computer coded map in the tunnel security client system.

12. The system of claim 11, wherein the already installed map is part of a car navigation system.

13. The system of claim 1, wherein a local area network is installed in the tunnel, and wherein locations of respective cars are identified by triangulation of WIFI signals between respective cats and nodes of the local area network inside the tunnel.

14. The system of claim 1, wherein an emergency network is established by a WIFI connection provided by at least one drone carrying a WIFI network connection, wherein the at least one drone is configured to search for live WIFI connections of cars inside the tunnel.

* * * * *